United States Patent [19]

Secker

[11] 3,997,817

[45] Dec. 14, 1976

[54] DEVICE FOR NEUTRALIZING THE CHARGE ON STATICALLY-CHARGED SURFACES

[76] Inventor: Philip Edward Secker, University College of North Wales, Bangor, Wales

[22] Filed: May 21, 1975

[21] Appl. No.: 579,426

[52] U.S. Cl. ..... 317/2 F; 310/8.7; 317/4

[51] Int. Cl.[2] ..... H05F 3/06

[58] Field of Search ..... 317/81, 2, 4, DIG. 11; 310/8.7; 322/2 R, 2 A

[56] References Cited

UNITED STATES PATENTS

| | | | |
|---|---|---|---|
| 2,531,338 | 11/1950 | Lobley et al. | 317/2 R X |
| 3,355,755 | 12/1967 | Brooks | 317/81 UX |
| 3,396,311 | 8/1968 | Maltner et al. | 317/81 |
| 3,576,471 | 4/1971 | Schumacher | 317/81 |

*Primary Examiner*—Harry Moose
*Attorney, Agent, or Firm*—Woodhams, Blanchard and Flynn

[57] ABSTRACT

A device, conveniently in the form of a pistol, comprising a piezo-electric generator connected to a discharge point. Squeezing the trigger of the pistol ejects a stream of positive or negative charge from the discharge point, releasing the trigger causes opposite charge to stream from the discharge point. The pistol is directed against statically-charged surfaces to neutralize the charge thereon.

12 Claims, 1 Drawing Figure

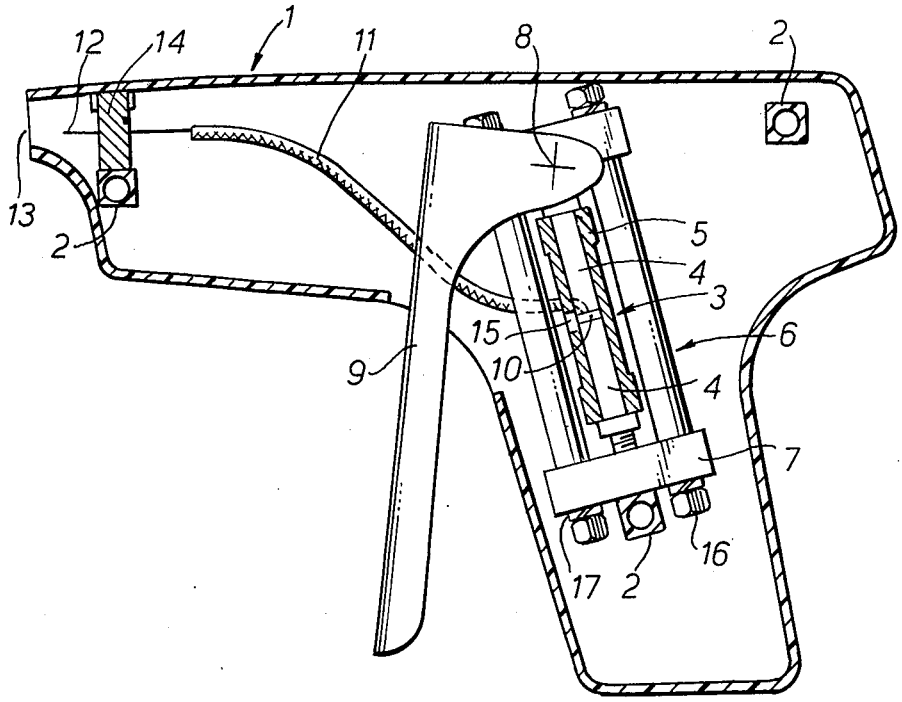
1
12
14
11
8
2
13
2
5
4
3
15
6
9
10
4
7
17
2
16

DEVICE FOR NEUTRALIZING THE CHARGE ON STATICALLY-CHARGED SURFACES

The present invention concerns a device for neutralizing the charge on statically-charged surfaces.

Certain crystals, examples of which are Rochelle salt and quartz, exhibit the piezo-electric effect whereby they develop an electric charge or potential difference across their crystal faces when subjected to mechanical strain. The invention utilizes this effect to provide an anti-static device.

According to the present invention a device for neutralizing the charge on statically-charged surfaces comprises a piezo-electric crystal assembly, means for generating voltages across the crystal faces of the assembly, and means for applying the so generated voltages to a sharp tip or point whereby to cause ionisation of an atmosphere in the region of the tip or cause ionisation of an atmosphere in the region of the tip or point.

Conveniently the device is constructed in the form of a pistol for convenience of handling. Operations of a trigger mechanism can apply a mechanical load to the crystal or crystals and the voltage output can be fed by an insulated conductor to a sharp tip, such as a sewing needle, located at the muzzle of the pistol.

The invention will be described further, by way of example, with reference to the accompanying drawing which shows a preferred embodiment in the form of a pistol.

With reference to the drawing, an anti-static pistol comprises a casing 1 formed in two substantially identical parts about the longitudinal centre line of the pistol. The casing is preferably formed from a robust plastics material and the two parts can be secured together by screws, the heads of which can be recessed in one part and the ends of which can engage in threaded bushes 2 in the other part. The said one part of the casing is not shown in the drawing in order to reveal the interior of the pistol.

The interior of the pistol contains a piezo-electric crystal or preferably and as shown an assembly 3 comprising a pair of piezo-electric crystals 4 arranged back to back within a plastics sheath 5. The crystal assembly is mounted in a mechanical frame 6. The lower end of the crystal assembly abuts against a support 7 on the frame 6. The support 7 is secured to the side members of the frame 6 by nuts 16 with spring washers 17 disposed between the nuts and the support 7. The upper end of the crystal assembly abuts against a pivot connection 8 for a trigger 9 such that operation of the trigger 9 produces axial loading of the crystals 4. The pivot 8 can be formed with a cammed profile or a projecting portion which bears against the upper end of the crystal assembly. The axial loading produces a potential difference between the ends of the crystals during compression. By suitable choice of crystal material and crystal geometry it is possible to generate voltages in excess of about 7kV. In operation, the polarization of the crystals is not important, that is, it is immaterial whether the squeezing of the trigger produces positive or negative high voltage since the opposite polarity output is produced on releasing the trigger to release the compressive force on the crystals. The trigger returns to its initial position under the action of the spring washers. It will be appreciated that other means can be employed for the spring return of the trigger.

A high voltage electrode 10 is situated between the adjacent ends of the crystals 4 and the output from the piezo-electric crystals is fed by an insulated cable or conductor 11 to a discharge point 12, for example the tip of a needle or pin. Conveniently the tip of the needle is located in the muzzle 13 of the pistol, the needle being supported by a plastics bush 14. The appearance of high voltage at the tip gives rise to local ionisation of the atmosphere around the tip. With positive voltage on the tip of the needle there is a net flow of positive ions from the tip region both due to the self diffusion of charge and as a result of the electric field emanating from the tip itself. Conversely, with negative voltage on the tip of the needle there is a net flow of negative ions away from the tip.

If a statically charged insulating object is placed within the operating range of the pistol, that is the range to which the ejected ions from the pistol are capable of diffusing in reasonable numbers, then there is a net attraction between static charge on the surface and the appropriate counter charge n the ion cloud. For example, consider a hi-fi record with positive static charge on its surface resulting from some prior treatment of the surface. With a pistol producing first positive charge and then negative charge, squeezing the trigger releases a stream of positive ions into the atmosphere. These positive ions are repelled by the positive ions on the record surface. When the trigger is released negative ions are ejected from the pistol and in this case there is an attraction between these ions and the positive charge on the record surface. The negative ions therefore drift towards the record surface and on reaching it either neutralize or minimize the external field effects of the static charge. It should be noted that once neutralization or field minimization has been achieved there is then no net attracting force for charge to move to the record surface.

In practice it is found that the anti-static pistol can neutralize a surface of area of at least one square foot when the pistol is held some one to two feet from it. For best operation it is advisable to squeeze the trigger of the pistol slowly, then wait a short time for the appropriate charge to diffuse away from the muzzle of the pistol before releasing the trigger slowly and generating the counter charge at the muzzle. Rapid operation of the trigger is undesirable for two reasons. First, if both the positive and negative streams are released almost simultaneously then neutralization occurs between these two streams and there is then little charge available for neutralizing static at the surface of the object to be discharged. The second disadvantage of rapid operation is that higher voltages than normal can be produced across the piezo-electric crystal which may result in internal breakdown. In some cases it is desirable to limit this voltage by incorporating within the pistol a simple spark gap 15 which flashes across when improper operation of the pistol is attempted.

Experiments have shown that with a properly adjusted piezo-electric crystal or crystals and the associated mounting frame it is possible to release from the muzzle of the pistol charge amounting to greater than $5 \times 10^{-7}$ coulombs both on squeezing the trigger and on releasing it. In operation it is convenient to hold the pistol approximately 20 cm. from the object to be discharged.

The anti-static pistol may be used to eliminate or reduce the static charge on any reasonably sized insulating surface. As mentioned it can be used to neutralize the surface charge on hi-fi records. Experiments suggest that a single operation of the pistol reduces the surface charge by as much as 90%. The anti-static pistol is also effective in reducing or eliminating the charge on photographic film during processing or handling. Other applications are in neutralizing static charge on transparent sheets of insulating material, such as perspex, which are often used for mounting pictures; for reducing static build-up on insulating bags used in the packaging industry, and for producing local charge reduction on carpets and textiles which may suffer from static problems. Yet other applications are the reduction of static charge on vacuum formed plastics objects, such as freezer inserts and plastics baths, and the reduction of charge in injection moulded plastics components. The above are but examples and are not exhaustive of many possible uses of the device according to the invention.

I claim:

1. A device for neutralizing the charge on statically-charged surfaces comprising a piezo-electric crystal assembly, means for generating voltages across the crystal faces of the assembly, a sharp discharge point isolated at a position to inhibit flashover and spark production and means for applying the so-generated voltages to said discharge point whereby to cause ionization of an atmosphere in the region of said discharge point.

2. A device according to claim 1 in which the assembly comprises a pair of crystals arranged back to back and a high voltage electrode between the crystals.

3. A device according to claim 1 in which the means for generating the voltages comprises a lever operable to alternately apply and release a compressive force to the crystal assembly.

4. A device according to claim 1 including a spark gap located remote from said discharge point for dissipating abnormally high voltages generated by the assembly.

5. A device according to claim 3 in which the crystal assembly is contained within a plastics sheath and supported in a frame between a fixed support and a pivot connection for the lever.

6. A device according to claim 4, including a frame, said crystal assembly comprising a crystal engaged between said frame and a high-voltage electrode, a plastic sheath containing said crystal assembly, said spark gap being formed by an opening in said sheath between said high voltage electrode and a close-spaced portion of said frame, such that generation of an abnormally high voltage by said crystal assembly produces a spark at said spark gap rather than at said discharge point.

7. A device according to claim 1, including an insulative casing surrounding said piezo-electric crystal assembly and said voltage applying means and said discharge point, said voltage applying means including a needlelike discharge conductor whose tip forms said sharp discharge point, said insulative casing peripherally surrounding said sharp discharge point and extending beyond said sharp discharge point to prevent unintended contact between said point and objects exterior of said casing, said insulative casing having an opening beyond said sharp discharge point for ionization of the external atmosphere at said casing opening by charge leakage at said sharp discharge point.

8. A device according to claim 7, in which said crystal assembly and said voltage generating means are located in said casing in remotely spaced relationship from said sharp discharge point, said voltage applying means including an elongated conductor extending from said crystal assembly to said needlelike discharge conductor and comprising the sole electrically conductive path extending into that portion of the casing in which said needlelike discharge conductor is located, whereby an electrical charge existent on the surface of an external object opposite said opening of said casing is neutralized by gradual leakage of charge from said sharp discharge point and consequent ionization of the atmosphere adjacent the discharge conductor carrying portion of the casing.

9. An anti-static device for neutralizing the charge on statically-charged surfaces comprising a pistol having a hollow casing of insulating material, a piezo-electric crystal assembly mounted within the casing, a trigger mechanism operable to alternately apply and release a compressive force to the crystal assembly, a sharp discharge point situated in the muzzle of the pistol, a conductor connecting the discharge point to the crystal assembly whereby operation of the trigger produces alternate streams of positive and negative charges at the discharge point, said discharge point being otherwise isolated from said crystal assembly to inhibit flashover and spark production at said discharge point.

10. A method of neutralizing a charge on a statically-charged surface, comprising:

alternately stressing and relieving a piezo-electric crystal assembly and thereby generating voltages across the crystal faces of such assembly;

applying said voltages to a sharp discharge point to produce alternate streams of positive and negative charges at said discharge point while protecting said sharp discharge point against spark discharge; and directing said charges to a statically-charged surface for neutralizing same.

11. The method of claim 10 in which said stressing and relieving are carried out gradually to minimize neutralization one by the other of successively produced positive and negative charge streams and to maximize the opportunity for a given said charge stream to neutralize said surface charge.

12. The method of claim 11 including locating said sharp discharge point at a distance of up to about two feet from said statically-charged surface at least during said stressing and relieving.

* * * * *